US005425157A

United States Patent [19]

Chang

[11] Patent Number: 5,425,157

[45] Date of Patent: Jun. 20, 1995

[54] HINGE DEVICE FOR PIVOTALLY CONNECTING TWO ELEMENTS

[75] Inventor: Citron Chang, Taipei, Taiwan, Prov. of China

[73] Assignee: Inventec Corporation, Taipei, Taiwan, Prov. of China

[21] Appl. No.: 258,520

[22] Filed: Jun. 10, 1994

[51] Int. Cl.[6] ..... E05D 3/06

[52] U.S. Cl. ..... 16/381; 16/386

[58] Field of Search ..... 16/270, 380, 381, 386

*Primary Examiner*—Mark Rosenbaum
*Assistant Examiner*—Kenneth J. Hansen
*Attorney, Agent, or Firm*—Ladas & Parry

[57] ABSTRACT

A hinge device includes first and second barrels, a pivot unit and a plug member. The pivot unit is constituted by first and second pins. The first pin has a front portion, a rear portion and an enlarged head between the front and rear portions and which is to be received engageably in a second section of the first barrel. The second pin has a shank and an enlarged head which is received engageably in a front section of the second barrel. A distal end of the shank extends beyond a rear section of the second barrel. The enlarged head of the second pin has a blind hole which permits extension of the rear portion of the first pin therein when the first and second barrels are disposed in alignment and the first pin is in the first barrel while the second pin is in the second barrel.

3 Claims, 3 Drawing Sheets

HINGE DEVICE FOR PIVOTALLY CONNECTING TWO ELEMENTS

BACKGROUND OF THE INVENTION

1. Field of the Invention

The invention relates to a hinge device, more particularly to a hinge device for pivotally connecting two elements, such as a main body of a calculator and a lid for covering the main body.

2. Description of the Related Art

Referring to FIGS. 1 and 2, a conventional hinge device for pivotally connecting two elements is shown to comprise a first barrel 1, a second barrel 2, a pivot unit 3 and a plug member 4.

The first barrel 1 is fixed to one of the elements 92, such as a main body of a calculator, and has a first end 101, a second end 102 opposite to the first end 101, and a passage 10 which extends through the first barrel 1 with a first section 11 adjacent to the first end 101 and a second section 12 continuous with the first section 11 and adjacent to the second end 102. The second section 12 has a polygonal cross section which is narrower than that of the first section 11. The first section 11 is confined by a first inner surface , while the second section 12 is confined by a second inner surface which is integral with the first inner surface, thereby forming a shoulder 104 between the first and second sections 11, 12. The first barrel 1 further has a pair of opposed channels 105 which extend through the shoulder 104 substantially parallel to the first and second inner surfaces and which open to the first section 11 and the second end 12 of the first barrel 1.

The second barrel 2 is fixed to the other one of the elements, such as a lid 91, and has a front end 201, a rear end 202 opposite to the front end 201, and a passage 20 which extends therethrough with a front section 21 that is polygonal in cross section and that is located adjacent to the front end 201 and a rear section 22 continuous with the front section 21. The rear section 22 has a cross section smaller than that of the front section 21.

The pivot unit 3 includes a pin member 30, a hexagonal sleeve member 31 and a clip member. The pin member 30 has a front portion 34, a rear portion 33 opposite to the front portion 34 and an enlarged head 35 between the front and rear portions 33, 34. The enlarged head 35 has an external face corresponding to the front section 21 of the second barrel 2. The hexagonal sleeve member 31 has an external surface corresponding to the second section 12 of the first barrel 1.

The first and second barrels 1, 2 are disposed side by side such that the passages 10, 20 are in alignment. The pin member 30 is inserted into the first and second barrel 1,2 such that the enlarged head 35 is received engageably in the front section 21 of the second barrel 2, the front portion 34 extends into the first barrel 1 and such that a free end of the rear portion 33 of the pin member 30 extends beyond the rear section 22 of the second barrel 2. The clip member is constituted by a circumferential groove 332 formed on the rear portion 33 of the pin member 30 adjacent to the free end of the latter and a C-shaped snap ring 331 which is snap-fitted in the circumferential groove 332 so as to prevent the pin member 30 from disengaging the second barrel 2. The hexagonal sleeve member 31 is inserted into the first barrel 1 such that it sleeves around the front portion 34 of the pin member 30 and engages the second section 12 of the first barrel 1. The sleeve member 31 is provided with a central hole which has a diameter greater than that of the front portion 34 of the pin member 30 so that a clearance is formed between the front portion 34 of the pin member 30 and an inner surface that confines the central hole of the sleeve member 31. A friction ring 32, generally made of plastic, is inserted into the clearance to provide friction when the sleeve member 31 is rotated relative to the front portion 34 of the pin member 30.

The plug member 4 has two hooked ribs 40 and is inserted into the first barrel 1 via the first end 101 such that the plug member 4 abuts the first end 101 of the first barrel 1 and a distal end of the front portion of the pin member 30 while the hooked ribs 40 pass through the first section 10 and the channels 105 of the first barrel 1 and engage the periphery that confines the second end 102 of the first barrel 1. Under this condition, the pin member 30 is retained within the first and second barrel 1, 2 and correspondingly prevents the first and second barrels 1, 2 from disengaging one another.

Some of the disadvantages that result with the use of the conventional hinge device are:

(I) The pivot unit 3 is constituted by three components, i.e. the pin member 30, the sleeve member 31 and the friction ring 32. Thus, a longer time and extra expense are incurred when producing.

(II) It is difficult to insert the friction ring 32 into the clearance which is formed between the inner surface of the sleeve member 31 and the front portion 34 of the pin member 30 after the pin member 30 and the sleeve member 31 have been assembled in the first and second barrel 1, 2.

SUMMARY OF THE INVENTION

A main objective of the present invention is to provide a hinge device which includes a pivot unit that has less components when compared to the conventional hinge device and that is easy to assemble.

According to the present invention, the hinge device includes a first barrel, a second barrel, a pivot unit, and means for preventing the pivot unit from disengaging the first barrel and a plug member. The first barrel, the second barrel, the plug member and the preventing means have the same configuration and structure as that disclosed in the conventional hinge device. The pivot unit employed in the hinge device of the present invention includes two separate pins, namely a first pin and a second pin. The first pin has a front portion, a rear portion opposite to the front portion and an enlarged head between the front and rear portions. The enlarged head has an external surface that corresponds to a second section of the first barrel. The second pin has a shank and an enlarged head at one end of the shank. The enlarged head of the second pin is provided with an external surface that corresponds to a front section of the second barrel and has a blind hole which is accessible from a direction opposite to the shank and which permits extension of the rear portion of the first pin therein. The first and second pins can be inserted into the first and second barrels when the latter are disposed side by side such that the passages are in alignment. Under this condition, the enlarged head of the second pin is received engageably in the front section of the second barrel while a free end of the shank of the second pin extends beyond the rear section of the second barrel. The enlarged head of the first pin is received engageably in the second section of the first barrel with the rear portion of the first pin extending into the blind hole of the second pin and the front portion of the first pin extending into the first section of the first barrel. The attachment of the preventing means and the plug member is the same as that in the conventional hinge device.

In the disclosed embodiment, one of the first and second barrels is made of plastic while the other one is made of metal so that friction occurs when one of the barrels is rotated relative to the other. No friction ring is required as in the conventional hinge device.

The first and second pins which constitute the pivot unit is produced in a known manner and can be inserted into the first and second barrels without any difficulty. Thus, the assembly of the hinge device is facilitated and the manufacturing expense incurred are correspondingly reduced.

BRIEF DESCRIPTION OF THE DRAWINGS

Other features and advantages of the present invention will become more apparent in the following detailed description of the preferred embodiment with reference to the accompanying drawings.

DETAILED DESCRIPTION OF THE PREFERRED EMBODIMENT

Figure 1:
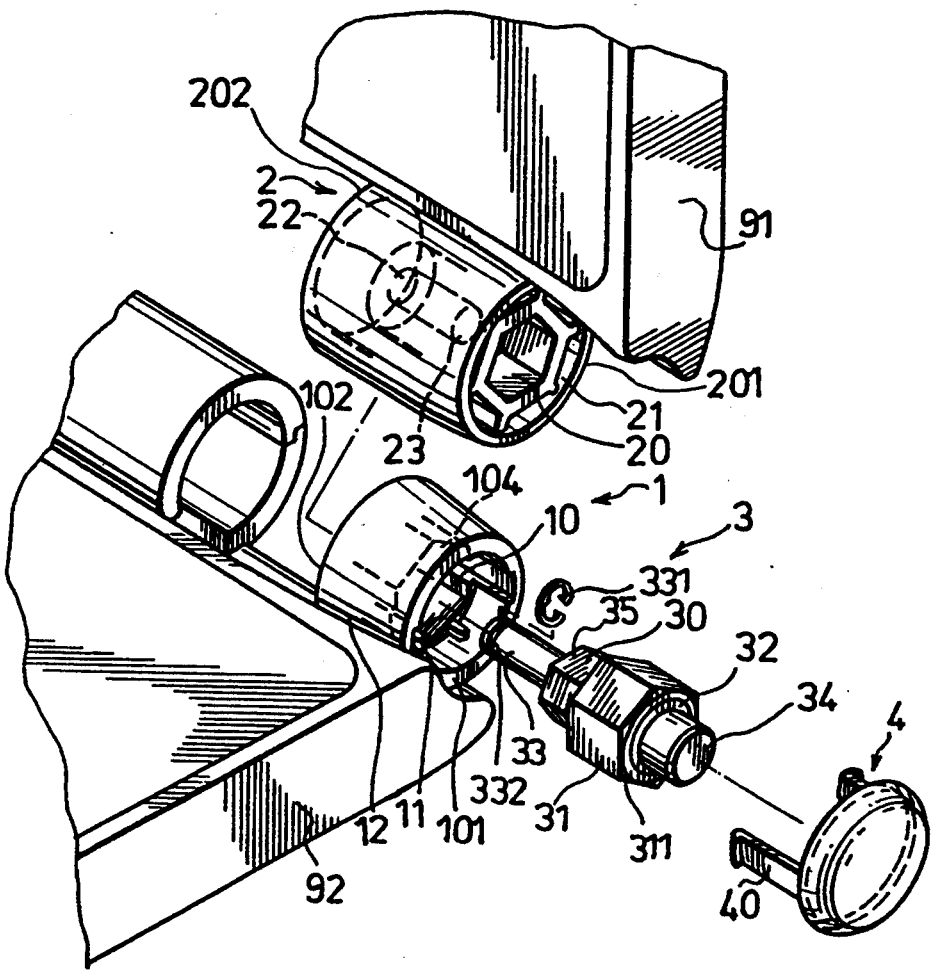
FIG. 1 (PRIOR ART)
FIG. 1 illustrates an exploded view of a conventional hinge device for connecting pivotally two elements.
Figure 2:
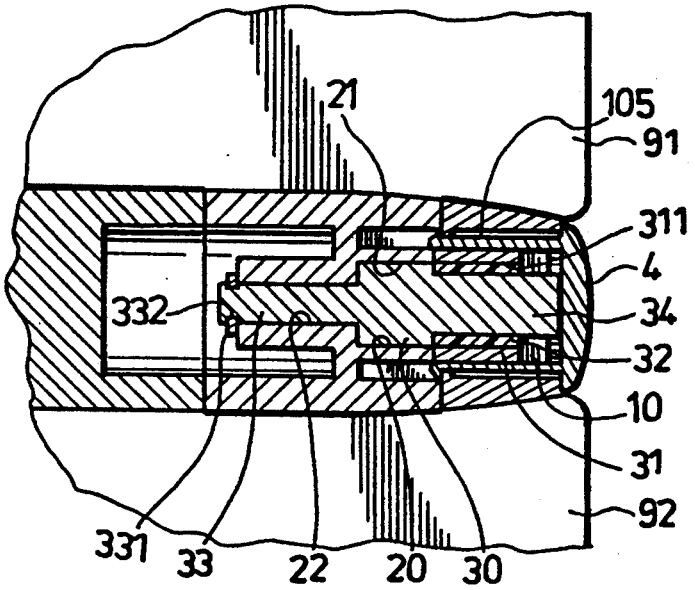
FIG. 2 (PRIOR ART)
FIG. 2 shows a cross sectional view of the conventional hinge device.
Figure 3:
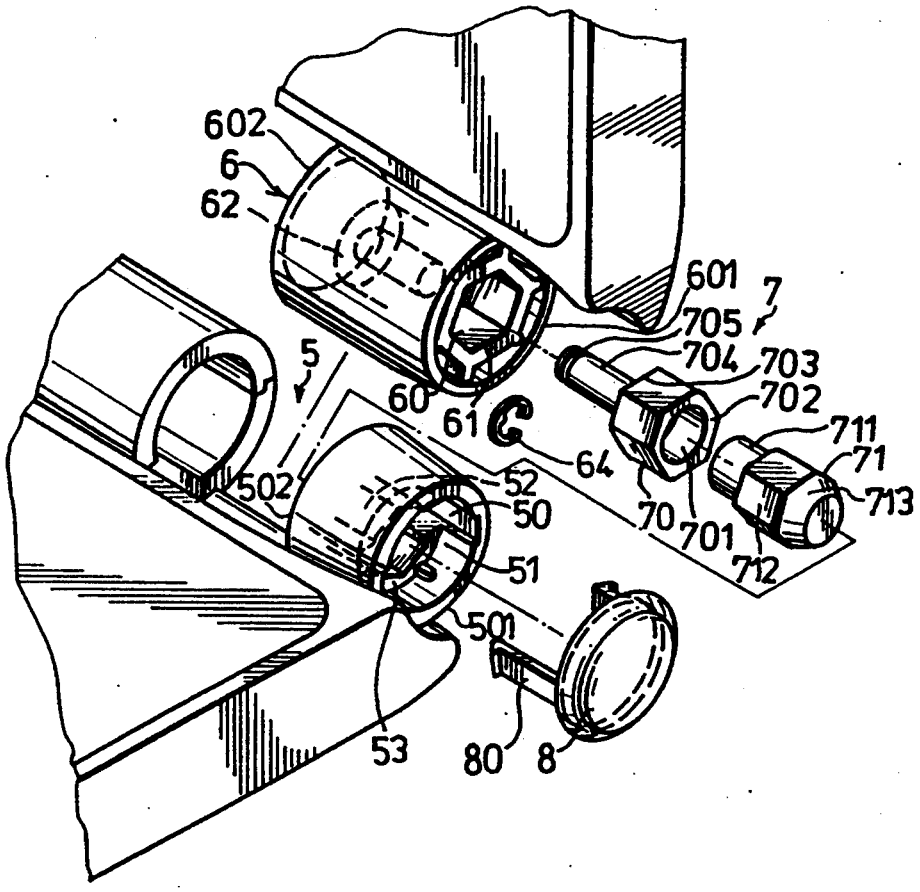
FIG. 3 illustrates an exploded view of a hinge device of the present invention for connecting pivotally two elements.
Figure 4:
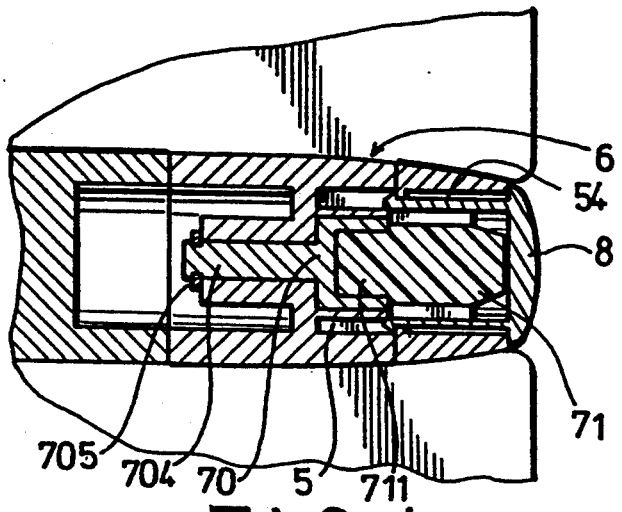
FIG. 4 is a cross sectional view of the hinge device of the present invention.

Referring to FIGS. 3 and 4, the preferred embodiment of a hinge device according to the present invention for pivotally connecting two elements is shown to comprises a first barrel 5, a second barrel 6, a pivot unit 7, a preventing means and a plug member 8.

The hinge device of the present invention is installed in a pocket calculator with a main body and a lid. The first barrel 5 is fixed to one end portion of the main body which has a display screen and a plurality of keys. The first barrel 5 has a first end 501, a second end 502 opposite to the first end 501, and a passage 50 which extends therethrough and which has a first section 51 adjacent to the first end 501 and a second section 52 continuous with the first section 51 and adjacent to the second end 502. The second section 52 has a polygonal cross section which is smaller than that of the first section 51. The first section 51 is confined by a first inner surface, while the second section 52 is confined by a second inner surface which is integral with the first inner surface. Thus, a shoulder 53 is formed between the first and second sections 51, 52. The first barrel 5 further has a pair of opposed channels 54 which extend through the shoulder 53 substantially parallel to the first and second inner surfaces and which open to the first section 51 and the second end 502 of the first barrel 5.

The second barrel 6 is fixed to the lid of the calculator such that the cover lid can be pivoted relative to the main body after assembly. The second barrel 6 has a front end 601, a rear end 602 opposite to the front end 601 and a passage 60 which extends therethrough and which has a front section 61 that is polygonal in cross section and that is located adjacent to the first end 601 and a rear section 62 continuous with the front section 61. The rear section 62 of the second barrel 6 has a cross section smaller than that of the front section 61.

The first and second barrels 5, 6 are disposed side by side such that the passages 50, 60 are in alignment. The pivot unit 7 employed in the present invention includes a first pin 71 and a second pin 70. The second pin 70 has a shank 704 with a free end and an enlarged head 703. The enlarged head 703 of the second pin 70 has an external surface that corresponds to the front section 61 of the second barrel 6. The enlarged head 703 of the second pin 70 further has a blind hole 701 which can receive the rear portion 711 of the first pin 71 therein. The second pin 70 is inserted into the second barrel 6 via the first barrel 5 such that the enlarged head 703 of the second pin 70 is received engageably in the front section 61 of the second barrel 6 and the free end of the shank 704 extends beyond the rear section 62 of the second barrel 6. Since the shank 704 of the second pin 70 has a circumferential groove 705 adjacent to the free end thereof, a C-shaped snap ring 64 can be fitted to the shank 704 so as to prevent the second pin 70 from disengaging the second barrel 6. The first pin 71 has a front portion 713, a rear portion 711 opposite to the front portion 713 and an enlarged head 712 between the front and rear portions 711, 713. The enlarged head 712 of the first pin 71 has an external surface that corresponds to the second section 52 of the first barrel 5. The first pin 71 is inserted into the first barrel 5 such that the enlarged head 712 of the same is received engageably in the second section 52 of the first barrel 5, the front portion 713 extends into the first section 51 of the first barrel 5, and such that the rear portion 711 extends into the blind hole 701 of the second pin 70, as shown in FIG. 4.

The plug member 8 has two hooked ribs 80 and is inserted into the first barrel 5 from the first end 501 of the same such that the plug member 8 abuts the periphery of the first end 501 of the first barrel 5 and a distal end of the front portion 713 of the first pin 71. The hooked ribs 80 of the plug member 8 pass through the first section 51 and the opposed channels 54 of the first barrel 5 and engage the inner periphery of the second end 502 of the first barrel 5. Thus, the first and second pins 71, 70 are retained within the first and second barrels 5, 6 and are prevented from disengaging one another. Since the rear portion 711 of the first pin 71 is retained rotatably in the blind hole 701 of the second pin 70, the first and second barrels 5, 6 can be rotated relative to one another.

Preferably, the first pin 71 is made of plastic while the second pin 70 is made of metal so that friction will occur when the first barrel 5 is rotated relative to the second barrel 6. The rear portion 711 of the first pin 70 provides friction sufficient to locate the first barrel 5 at a desired position relative to the second barrel 6 so that the cover lid can be positioned at a desired angle relative to the main body of the calculator.

From the above explanation, it can be clearly seen that the rear portion of the first pin 71 can easily fit into the blind hole 701 of the second pin 70 after the latter is inserted in the second barrel 6. Thus, assembly of the hinge device of the present invention is facilitated to result in reduced manufacturing costs.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A hinge device for connecting two elements, said hinge device comprising:

a first barrel to be fixed to one of said elements and having a first end, a second end opposite to said first end, and a passage which extends therethrough and which has a first section adjacent to said first end and a second section continuous with said first section and adjacent to said second end, said second section having a polygonal cross section which is smaller than that of said first section, said first section being confined by a first inner surface and said second section being confined by a second inner surface which is integral with said first inner surface, thereby forming a shoulder between said first and second sections, said first barrel further having a pair of opposed channels which extend through said shoulder substantially parallel to said first and second inner surfaces and which open to said first section and said second end of said first barrel;

a second barrel to be fixed to a remaining one of said elements and having a front end, a rear end opposite to said front end, and a passage which is formed therethrough and which has a front section that is polygonal in cross section and that is adjacent to said first end and a rear section continuous with said front section, said rear section having a cross section smaller than that of said front section;

a pivot unit including a first pin and a second pin, said first pin having a front portion, a rear portion opposite to said front portion and an enlarged head between said front and rear portions, said enlarged head having an external surface corresponding to said second section of said first barrel, said first pin being inserted into said first barrel such that said enlarged head is received engageably in said second section of said first barrel, said front portion extends into said first section of said first barrel and such that said rear portion extends out from said second section of said first barrel, said second pin having a shank with a free end and an enlarged head, said enlarged head of said second pin having an external surface corresponding to said front section of said second barrel, said second pin being inserted in said second barrel such that said enlarged head is received engageably in said front section of said second barrel and said shank extends beyond said rear section, said enlarged head of said second pin further having a blind hole which permits said rear portion of said first pin member to extend therein when said first and second barrels are located side by side such that the passages are in alignment;

means for preventing said second pin from disengaging said second barrel; and a plug member inserted into said barrel via said first end of said barrel, said plug member abutting said first end of said first barrel and said front portion of said first pin, said plug member having two hooked ribs which pass through said first section and said opposed channels of said first barrel and which engage the periphery confining said second end of said first barrel, thereby retaining said rear portion of said first pin rotatably in said blind hole of said second pin and correspondingly preventing said first and second barrels from disengaging one another.

2. The hinge device as defined in claim 1, wherein said preventing means is constituted by a circumferential groove formed on said shank of said second pin adjacent to said free end and a C-shaped snap ring to be received in said circumferential groove.

3. The hinge device as defined in claim 1, wherein one of said first and second pins is made of plastic and the other one of said first and second pins is made of metal.

* * * * *